US007140419B2

(12) United States Patent
Doutre et al.

(10) Patent No.: US 7,140,419 B2
(45) Date of Patent: Nov. 28, 2006

(54) SEMI-SOLID CONCENTRATION PROCESSING OF METALLIC ALLOYS

(75) Inventors: Don Doutre, Kingston (CA); Gary Hay, Ontario (CA); Peter Wales, Kingston (CA)

(73) Assignee: Alcan Internatinoal Limited, Toronto (CA)

( * ) Notice: Subject to any disclaimer, the term of this patent is extended or adjusted under 35 U.S.C. 154(b) by 0 days.

(21) Appl. No.: 10/177,283

(22) Filed: Jun. 20, 2002

(65) Prior Publication Data

US 2002/0189724 A1 Dec. 19, 2002

Related U.S. Application Data

(62) Division of application No. 09/361,336, filed on Jul. 26, 1999, now Pat. No. 6,428,636.

(51) Int. Cl.
*B22D 17/00* (2006.01)

(52) U.S. Cl. ..... 164/900; 164/113; 148/549; 148/538

(58) Field of Classification Search ..... 164/900, 164/113; 148/549, 538
See application file for complete search history.

(56) References Cited

U.S. PATENT DOCUMENTS

| | | | | |
|---|---|---|---|---|
| 3,537,695 | A | 11/1970 | Robinson et al. | |
| 3,840,364 | A | 10/1974 | Flemings et al. | |
| 4,106,956 | A | 8/1978 | Bercovici | |
| 4,345,637 | A * | 8/1982 | Flemings et al. | 164/113 |
| 4,572,818 | A | 2/1986 | Flemings | |
| 4,694,881 | A | 9/1987 | Busk | |
| 4,738,712 | A | 4/1988 | Singer | |
| 4,964,455 | A | 10/1990 | Meyer | |
| 5,501,266 | A | 3/1996 | Wang et al. | |
| 5,579,825 | A | 12/1996 | Shibata et al. | |
| 5,701,942 | A | 12/1997 | Adachi et al. | |
| 5,832,982 | A | 11/1998 | Williams et al. | |
| 5,836,372 | A | 11/1998 | Kono | |

(Continued)

FOREIGN PATENT DOCUMENTS

EP 0392998 A1 10/1990

(Continued)

OTHER PUBLICATIONS

R. Mehabrian et al., "Refining by Partial Solidification", *Met Trans.* vol. 5, 1974, pp. 785-787.

*Primary Examiner*—George Wyszomierski
*Assistant Examiner*—Janelle Morillo
(74) *Attorney, Agent, or Firm*—Cooper & Dunham LLP

(57) ABSTRACT

A metallic alloy having a semi-solid range between the liquidus temperature and the solidus temperature of the metallic alloy is processed by cooling the metallic alloy from an initial metallic alloy elevated temperature to a semi-solid temperature of less than the liquidus temperature and more than the solidus temperature, and maintaining the metallic alloy at the semi-solid temperature for a sufficient time to produce a semi-solid structure in the metallic alloy of a globular solid phase dispersed in a liquid phase. The cooling may be accomplished by providing a crucible at a crucible initial temperature below the solidus temperature, pouring the metallic alloy into the crucible, and allowing the metallic alloy and the crucible to reach a thermal equilibrium between the liquidus temperature and the solidus temperature of the metallic alloy. The method further includes removing at least some, but not all, of the liquid phase present in the semi-solid structure of the metallic alloy to form a solid-enriched semi-solid structure of the metallic alloy, and forming the metallic alloy having the solid-enriched semi-solid structure into a shape.

7 Claims, 4 Drawing Sheets

U.S. PATENT DOCUMENTS

| | | | |
|---|---|---|---|
| 5,879,478 | A | 3/1999 | Loue et al. |
| 5,979,534 | A | 11/1999 | Shibata et al. |
| 6,165,411 | A | 12/2000 | Adachi et al. |
| 6,428,636 | B1 | 8/2002 | Doutre et al. |
| 6,595,266 | B1 | 7/2003 | Orii |
| 6,769,473 | B1 | 8/2004 | Adachi et al. |

FOREIGN PATENT DOCUMENTS

| | | | | |
|---|---|---|---|---|
| EP | 0 701 002 | A1 | | 3/1996 |
| EP | 0 745 694 | A1 | | 4/1996 |
| EP | 0 719 606 | A1 | | 7/1996 |
| EP | 0 841 406 | A1 | | 5/1998 |
| EP | 0 903 193 | A1 | | 3/1999 |
| EP | 903193 | A1 | * | 3/1999 |
| HU | P9902156 | | | 11/1999 |
| WO | WO 96/38593 | | | 12/1996 |
| WO | WO 99/36209 | | | 7/1999 |

* cited by examiner

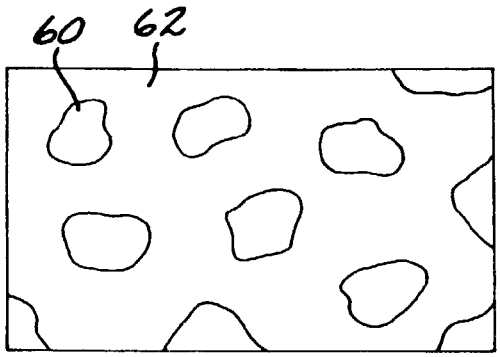
FIG. 7
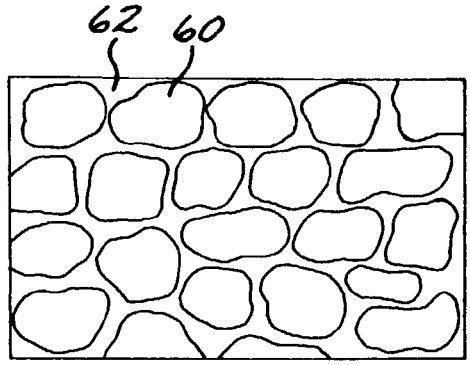
FIG. 8
FIG. 9
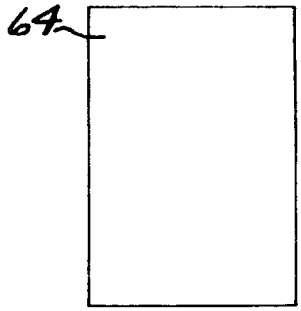
FIG. 10
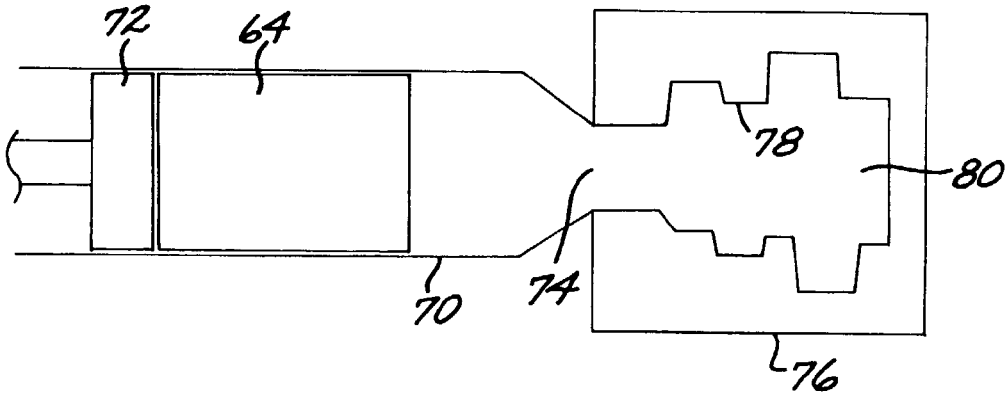

SEMI-SOLID CONCENTRATION PROCESSING OF METALLIC ALLOYS

This application is a division of application Ser. No. 09/361,336, filed Jul. 26, 1999 now U.S. Pat. No. 6,428,636, for which priority is claimed.

BACKGROUND OF THE INVENTION

This invention relates to solidification processing of metallic alloys, and, more particularly, to semi-solid processing of metallic alloys.

The casting of a metal into a useful shape involves heating the metal to a temperature above its melting point, placing the molten metal into a form termed a mold, and cooling the metal to a temperature below its melting point. The metal solidifies in the shape defined by the mold, and is thereafter removed from the mold. Within these general guidelines, a wide variety of casting technologies are known.

When most metallic alloys are cooled from the molten state, they do not solidify at a single temperature, but over a temperature range. As the metal is cooled, it first reaches a liquidus temperature at which the alloy begins to freeze. As the temperature is further reduced, an increasing fraction of the metal becomes solid, until the metal is entirely solid below a solidus temperature.

In conventional casting practice, the metal is cooled from the molten state above the liquidus temperature to the solid state below the solidus temperature, without being held at a temperature between the liquidus temperature and the solidus temperature. However, it is known to cool the metal to a semi-solid temperature range between the liquidus temperature and the solidus temperature and hold the metal at that temperature, so that the metal is in a semi-solid state. Alternatively, the metal may be heated from a temperature below the solidus temperature to the semi-solid temperature range between the liquidus temperature and the solidus temperature. By whatever path the metal reaches this semi-solid temperature range, the semi-solid material is then processed to produce a structure of solid globules in a liquid matrix. This process may involve intensive stirring, but if suitable conditions are achieved to give many crystallization nuclei (for example by rapid cooling or using suitable grain refinement techniques) the process may involve only an aging step. The semi-solid mixture is then forced into a mold while in this semi-solid state, typically by die casting.

In the conventional semi-solid casting technique, careful control is required over the heating and cooling parameters, specifically the holding temperature at which the processing apparatus is maintained. The present inventors have realized that for commercial purposes the conventional approach is confined to use with alloys having a low rate of increase of the fraction of solids with decreasing temperature, at the semi-solid processing temperature. Consequently, many alloys are excluded from practical commercial semi-solid processing, unless a high degree of control on temperature (requiring expensive equipment) is achieved. This high degree of control is not possible or not practical for many commercial semi-solid casting operations Accordingly, there is a need for an improved approach to the semi-solid casting of metallic alloys, which is less restrictive on processing parameters and produces a better-quality final product. The present invention fulfills this need, and further provides related advantages.

SUMMARY OF THE INVENTION

This invention provides a method for semi-solid processing of metallic alloys, which is operable with a variety of metals having both high and low variation of solids content with temperature in the semi-solid temperature range. The approach of the invention does not require intensive stirring and/or mixing in the semi-solid range, resulting in improved quality of the final cast product as a result of reduced incorporation of defects into the semi-solid material and thence into the cast product. The approach also allows the relative fraction of solid and liquid to be controllably varied in the semi-solid structure without changing temperature, so that the structure of the as-cast product may similarly be varied. Recycling of materials in the casting plant is also facilitated. In a preferred embodiment, temperature control of the metallic alloy is significantly simplified, with the result that materials having very narrow operable temperature ranges in the semi-solid state may be processed.

In accordance with the invention, a metallic alloy having a liquidus temperature and a solidus temperature is processed. The method comprises the steps of providing the metallic alloy having a semi-solid range between the liquidus temperature and the solidus temperature of the metallic alloy, heating the metallic alloy to an alloy initial elevated temperature above the liquidus temperature, reducing the temperature of the metallic alloy from the initial metallic alloy elevated temperature to a semi-solid temperature of less than the liquidus temperature and more than the solidus temperature, and maintaining the metallic alloy at the semi-solid temperature for a sufficient time to produce a semi-solid structure in the metallic alloy of a globular solid phase dispersed in a liquid phase, which is usually between 1 second and 5 minutes. The method optionally further includes removing at least some, but not all, of the liquid phase present in the semi-solid structure of the metallic alloy to form a solid-enriched semi-solid structure of the metallic alloy. The metallic alloy having the semi-solid structure or the solid-enriched semi-solid structure is formed into a shape.

In a particularly preferred embodiment, the metallic alloy is cooled from above the liquidus temperature to the semi-solid temperature by providing a crucible at a crucible initial temperature below the solidus temperature, pouring the metallic alloy into the crucible, and allowing the temperature of the metallic alloy and the crucible to reach an equilibrium at the semi-solid temperature. The relative masses and properties of the metallic alloy and the crucible and their initial temperatures are preferably selected such that, when thermal equilibrium between the two is reached, the metallic alloy and the crucible are at the desired semi-solid temperature. Temperature control is simplified, and metallic alloys with a high rate of weight fraction solids formation with decreasing temperature may be processed.

If the particularly preferred embodiment is used, the semi-solid mixture may be directly transferred to a die casting machine without solidifying it, and die casting the resulting semi-solid globularized mixture. However, it is preferred to include the step of removing at least some liquid phase prior to casting, as this permits the globularization step to occur under conditions where there is substantial liquid phase present, resulting in more efficient heat and mass transfer.

The removal of liquid phase, where used, is preferably accomplished by allowing liquid to drain from the semi-solid material through a filter or other porous structure, thereby increasing the relative amount of the solid material in the semi-solid material. In a typical case, the semi-solid structure initially has less than about 50 weight percent solid phase, preferably from about 20 to about 35 weight percent, and the liquid phase is removed until the solid-enriched semi-solid structure has from about 35 to about 55 weight percent, preferably about 45 weight percent, of solid phase present as determined by the procedures described subsequently.

After concentration of the solid weight fraction accomplished by removal of liquid phase, the metallic alloy is thixotropic. That it, it may be handled in the manner of a solid, but may then be formed to a final shape by any operable liquids-processing technique such as pressure die casting.

The present invention may be used with any material having a semi-solid range, but is preferably practiced with aluminum alloys. It may be performed with alloys that are reinforced with a phase that remains solid throughout processing, producing a final cast reinforced composite material.

The present invention also provides a modified alloy composition that is suitable for use with the processing described above. The modified alloy composition allows the production of solid product of a desired final composition when processed by the procedure in which some liquid phase is removed. In accordance with this aspect of the invention, a modified alloy composition comprises a base alloy having its solute elements adjusted to account for removal of a portion of the base alloy as a liquid phase at a semi-solid temperature between a liquidus temperature and a solidus temperature of the modified alloy composition, whereupon the remaining material after removal of the liquid phase has the base alloy composition. Stated alternatively, the invention provides a modified alloy whose composition is determined by the steps of providing a base alloy having a base alloy composition, and performing a separation procedure with the base alloy as a starting material. The separation procedure includes the steps of heating the starting material to above its liquidus temperature, cooling the starting material to a semi-solid temperature between its liquidus temperature and its solidus temperature, at which semi-solid temperature the starting material has a liquid portion and a solid portion of different composition than the liquid portion, and removing at least part of the liquid portion to leave a remaining portion having a remaining composition different from that of the starting material. A modified alloy composition is determined such that, when the modified alloy composition is processed by the separation procedure using the modified alloy as the starting material, its remaining composition is substantially the base alloy composition.

In conceiving the present invention, the present inventors have realized that, as a practical matter, the conventional approach to semi-solid processing is limited in a commercial setting to alloys having an absolute value of the temperature rate of change of percent solids at the holding temperature of about 1 weight percent solids per degree Centigrade or less. The present approach allows the semi-solid processing of alloys having an absolute value of the temperature rate of change of percent solids at the holding temperature that is greater than about 1 weight percent solids per degree Centigrade, and even greater than about 2 weight percent solids per degree Centigrade. The present approach therefore opens the way to the semi-solid processing of many alloys heretofore extremely difficult or impossible to process commercially. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 7 is an idealized micrograph of the metallic alloy prior to removal of liquid;

FIG. 8 is an idealized micrograph of the metallic alloy after removal of liquid;

FIG. 9 is an elevational view of a freestanding billet of the semi-solid material; and FIG. 10 is a schematic sectional view of a forming apparatus for the semi-solid material.

DETAILED DESCRIPTION OF THE INVENTION

Figure 1:
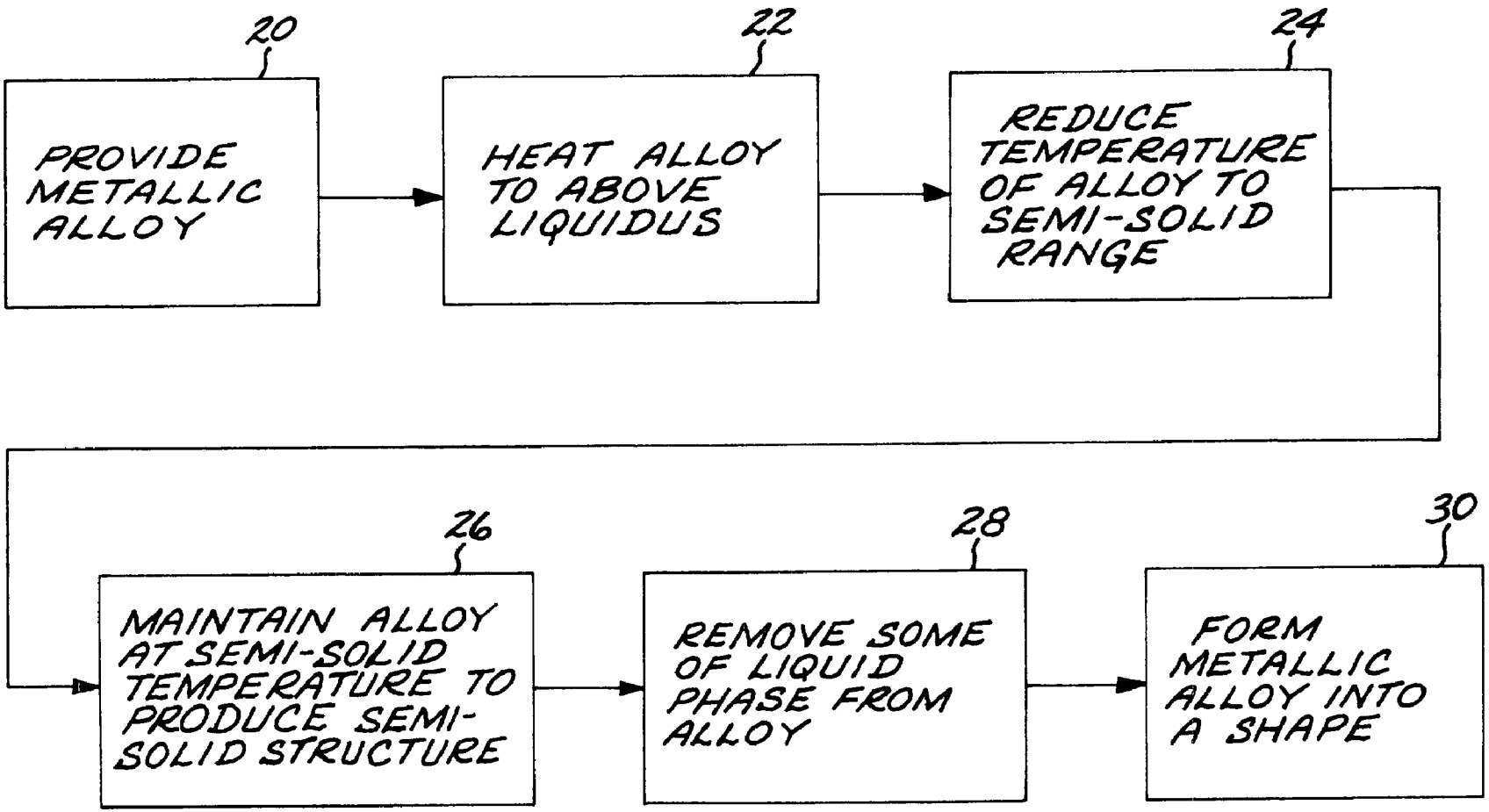
FIG. 1 is a block flow diagram of an approach for practicing the invention.
Figure 2:
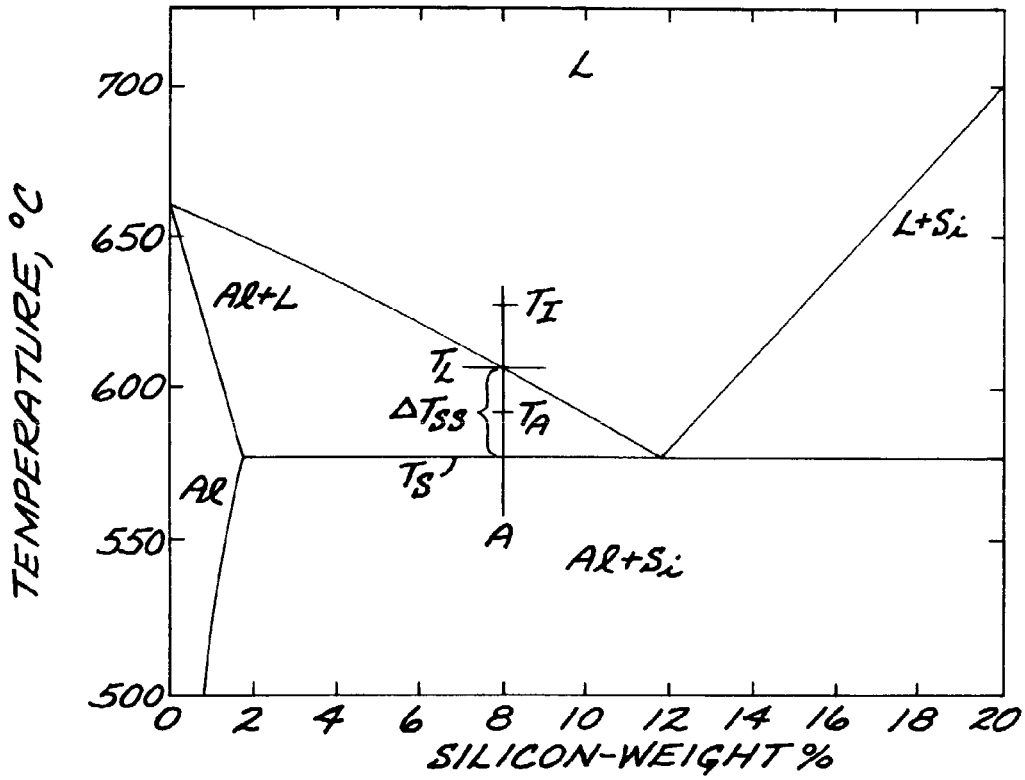
FIG. 2 depicts a first form of phase diagram of an operable metallic alloy.
Figure 3:
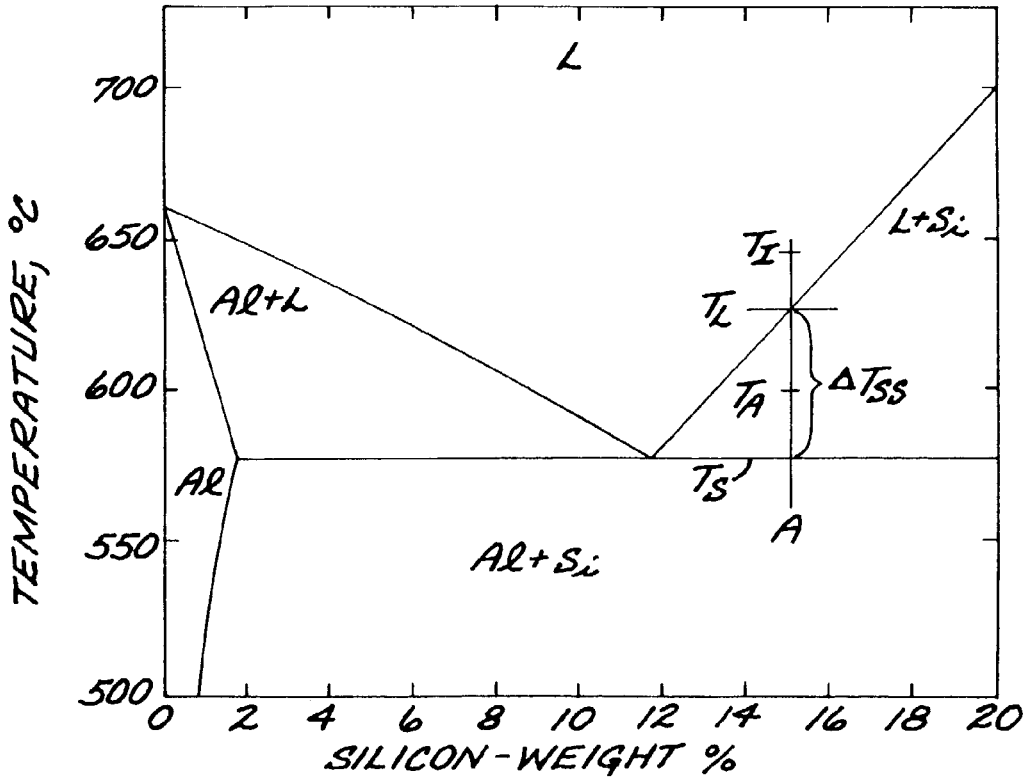
FIG. 3 depicts a second form of phase diagram of an operable metallic alloy.

FIG. 1 depicts in block diagram form an approach for practicing the method of the invention. A metallic alloy is provided, numeral 20. The metallic alloy is one which exhibits a semi-solid range during solidification between a liquidus temperature and a solidus temperature. FIGS. 2 and 3 are partial temperature-composition phase diagrams of the aluminum-silicon binary system illustrating two typical types of metallic alloys of this type, wherein the liquidus temperature decreases with increasing silicon solute content (FIG. 2) and wherein the liquidus temperature increases with increasing solute content (a different portion of the Al—Si binary system, FIG. 3). In both figures, a metallic alloy of composition A has a liquidus temperature $T_L$ and a solidus temperature $T_S$. At temperatures above $T_L$, the metallic alloy is entirely liquid phase, and at temperatures below $T_S$, the metallic alloy is entirely solid phase. In a temperature range $\Delta T_{SS}$ between $T_L$ and $T_S$ the alloy is a semi-solid mixture of liquid and solid phases, with the relative proportions of liquid and solid phases determinable by the lever rule.

Many metallic alloys are characterized by phase diagrams such as those discussed in relation to FIGS. 2 and 3. The use of aluminum alloys is of particular interest to the present inventors, but other types of alloys are operable as well. (As used herein, an alloy is characterized by the element that is present in greatest proportion. Thus, an "aluminum" alloy has more aluminum than any other element.) Examples of operable aluminum alloy are Alloy A356, having a nominal composition in weight percent of aluminum, 7.0 silicon, and 0.3 percent magnesium; and Alloy AA6061, having a nominal composition in weight percent of aluminum, 1.0 percent magnesium, 0.6 percent silicon, 0.3 percent copper, and 0.2 percent chromium. Preferably, a grain refiner is added to the alloy for the present approach. The grain refiner may be, for example, a titanium-boron composition that yields up to about 0.03 weight percent titanium in the alloy.

The metallic alloy may be mixed with other phases that remain solid throughout all of the procedures discussed herein. Such other phases may be present unintentionally, such as oxide inclusions and stringers. Such other phases may also be present intentionally, such as aluminum oxide or silicon carbide reinforcing phases. The presence of such phases does not prevent operability of the present invention, provided that the total solids in the mixture prior to removal of liquid phase remains less than about 50 weight percent and preferably from about 20 to about 35 weight percent.

Returning to FIG. 1, the metallic alloy is heated to an alloy initial elevated temperature $T_I$ above the liquidus temperature $T_L$ to fully melt the alloy, numeral 22.

The temperature of the metallic alloy is thereafter reduced, numeral 24, from the initial metallic alloy elevated temperature $T_I$ to a semi-solid temperature $T_A$ that is less than the liquidus temperature $T_L$ and greater than the solidus temperature $T_S$, and is within the range $\Delta T_{SS}$.

Figure 4:
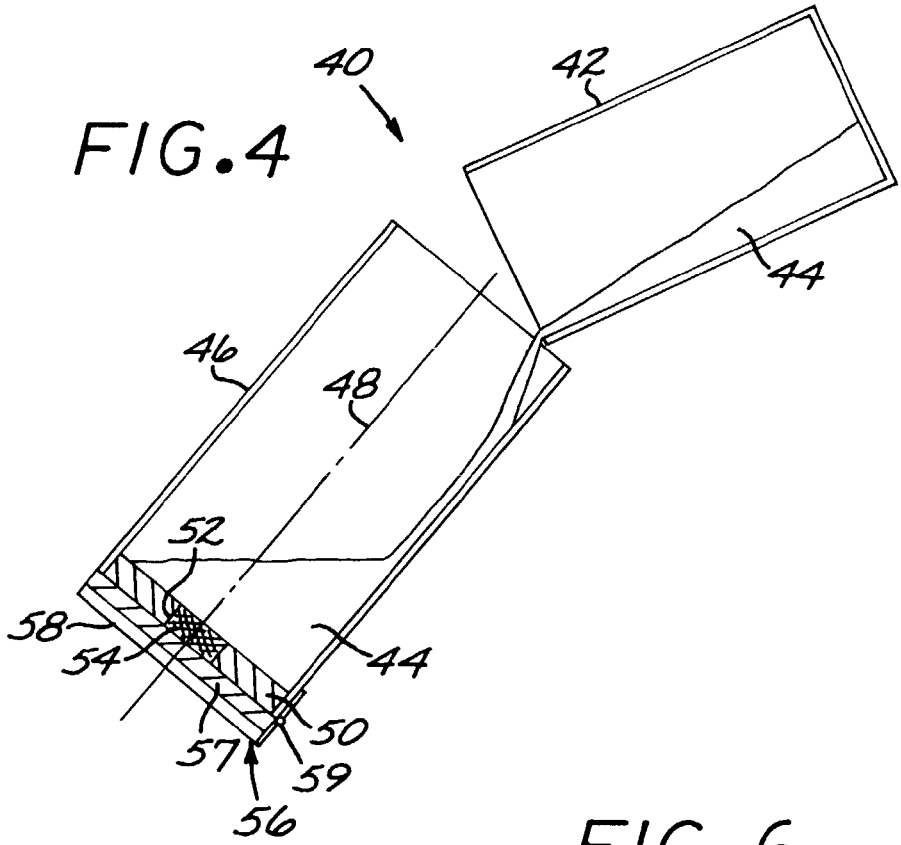
FIG. 4 is a schematic side sectional view of a crucible in the tilted pouring position.

The heating step 22 and the temperature-reducing step 24 may be accomplished in any operable manner and with any operable apparatus. FIG. 4 illustrates a preferred apparatus 40. The heating step 22 is accomplished with a heating vessel 42 made of a material that withstands the molten alloy. The heating vessel 42 may be heated in an oven, resistively, inductively, or by any other operable heating source. The temperature-reducing step 24 is preferably accomplished by pouring the molten metal 44 from the heating vessel 42 into a crucible 46.

In the preferred approach, the material of construction and structural parameters of the crucible 46 are carefully chosen, in conjunction with the type and amount of the molten metallic alloy, to aid in cooling the molten metallic alloy precisely to a chosen value of $T_A$. The design principle is that the enthalpy change $\Delta H_C$ of the crucible 46 as it is heated from its crucible initial temperature to $T_A$ is equal to the enthalpy change $\Delta H_M$ of the molten metallic alloy as it is cooled from $T_I$ to $T_A$. The value of $\Delta H_C$ is calculated as the integral $\int M_C C_{P,C} dT$ (where $M_C$ is the mass of the crucible, $C_{P,C}$ is the heat capacity of the crucible, which is usually itself a function of temperature, and dT is the differential temperature), corrected by the amount of heat lost from the crucible surface by radiation and convection from the time at which the molten alloy is poured into the crucible until the value of $F_S$ is determined. The radiative and convective heat losses are determined from the dimensions of the crucible and its surface emissivity, plus known convective heat transfer coefficients. The limits of integration are from the crucible initial temperature, typically room temperature, to the desired $T_A$. The value of $\Delta H_M$ is calculated as $(\int M_M C_{P,M} dT + F_S M_M H_F)$, where $M_M$ is the mass of the molten metal, and $C_{P,M}$ is the heat capacity of the molten metal, which is usually itself a function of temperature. The limits of integration are from $T_I$ to $T_A$. In the second term, $F_S$ is the fraction of the metallic alloy that has solidified at $T_A$, determined by the lever rule, and $H_F$ is the heat of fusion of the transformation of the metallic alloy from liquid to solid. All of these values are readily determined from available technical information such as thermodynamic data compilations and the relevant portion of the temperature-composition phase diagram.

Establishing the temperature $T_A$ to which the metallic alloy is cooled in step 24 in this manner has an important practical advantage. The cooling of large masses of metallic alloy to a precise elevated temperature is ordinarily difficult. If a large mass of metallic alloy is placed into a temperature-controlled environment such as a furnace, a period of hours may be required to reach an equilibrium. That is highly undesirable for the present application, as there may be a coarsening of the solid globules observed in the metallic alloy at $T_A$, as will be discussed subsequently. Using the present approach, the temperature equilibration at $T_A$ of the crucible 46 and the molten metal in the crucible 46 is achieved within a period of a few seconds. Further, the value of $T_A$ may be established quite precisely to within a few degrees. This is important because the temperature rate of change of weight fraction of solids may be large for some alloys. That is, a small change in temperature $T_A$ can result in a large change in the solids content of the semi-solid mixture. The present approach allows the temperature of the metallic alloy to be established and maintained very precisely. If conventional techniques are used, the temperature rate of change of weight fraction solids for a workable alloy at $T_A$ must be about 1 percent per degree Centigrade or less, whereas in the present approach alloys having a temperature rate of weight fraction change in excess of about 1 percent per degree Centigrade, and even in excess of about 2 weight percent per degree Centigrade, at $T_A$ may be usefully prepared in semi-solid form and cast.

The crucible 46 is made of a material that withstands the molten metallic alloy. Preferably, it is made of a metal side wall with a higher melting point than $T_I$, and a multi-piece refractory bottom whose structure will be described subsequently The external surface of the crucible may optionally be insulated entirely or in part to reduce heat loss during processing. The use of a metal crucible aids in achieving rapid heat flow for temperature equilibration, and is inexpensive. A steel crucible 46 coated with mica wash may be used for aluminum metallic alloys.

The crucible 46 is preferably cylindrical in cross section with a cylindrical axis 48. The crucible 46 is mounted in a support that rotates the crucible 46 about its cylindrical axis 48. When the molten metallic alloy is poured from the heating vessel 42 into the crucible 46, the crucible 46 may be oriented at an inclined angle as illustrated in FIG. 4. Care is taken to achieve temperature equilibrium between the molten metallic alloy and the crucible wall as rapidly as possible. The rapid temperature equilibrium is preferably achieved by moving the mass of molten metal relative to the crucible wall in such a way that a stationary temperature boundary layer in the molten metal adjacent to the crucible wall is avoided. Fresh hot molten metal is constantly brought into contact with the crucible wall, avoiding hot spots and cold spots in the molten metal so that temperature equilibrium between the molten metal and the crucible is reached rapidly. The molten metal may be moved relative to the crucible wall in any of several modes, or a combination thereof, all of which promote the rapid temperature equilibration. In one mode of movement, the crucible is rotated about its cylindrical axis, while either inclined or upright. It is also advantageous to impart some swirling or similar motion to the liquid metal to prevent adherence of solidifying metal to the walls. Such swirling motion may be achieved by precessing the inclined cylindrical axis, by rotating the cylindrical axis about a center laterally separated from the cylindrical axis, by moving the cylindrical axis along a pattern lying in a plane perpendicular to the cylindrical axis, by periodically altering the inclination angle of an inclined crucible, or by any other operable movement. In another approach, a scraper may contact the inside of the wall of the crucible 46. Typically when one of these techniques is used, the equilibrium temperature $T_A$ in both the molten metallic alloy and the crucible is reached within a few seconds at most after the pouring is completed.

After pouring the molten metallic alloy into the crucible 46 and equilibration at temperature $T_A$ is reached, the molten metallic alloy is maintained at temperature $T_A$ for a period of time sufficient to produce a semi-solid structure in the metallic alloy of a globular solid phase dispersed in a liquid phase, numeral 26. This period of time is typically from about 1 second to about 5 minutes (preferably no more than about 2 minutes), depending principally on the kinetics in the metallic alloy. The inventors have observed that for typical aluminum alloys, the required time is only a few seconds, so that the semi-solid structure is reached by the time that the next step of the processing is performed. In effect, there is no noticeable delay required in the processing.

Figure 5:
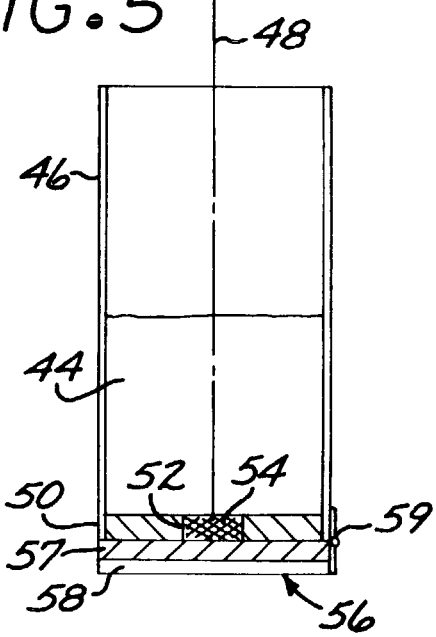
FIG. 5 is a schematic side sectional view of the crucible of FIG. 4 in the vertical concentrating position, but prior to liquid phase removal.
Figure 6:
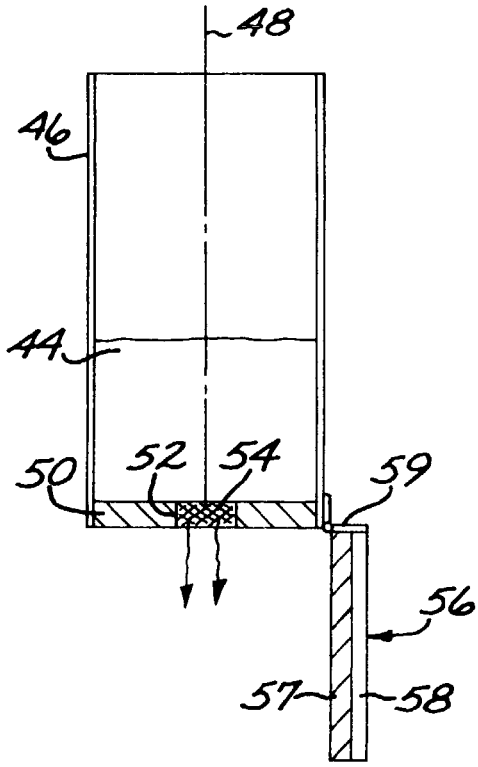
FIG. 6 is a schematic side sectional view of the crucible of FIG. 4 in the vertical concentrating position, during liquid phase removal.

Optionally, some but not all of the liquid is removed from the semi-solid structure, numeral 28. Removal is preferably accomplished as shown in FIGS. 5–6. The crucible 46 is formed with a solid bottom 50 having an opening 52 therein. In an apparatus built by the inventors to process aluminum alloys, the diameter of the opening 52 is about 10 millimeters. A porous material in the form of a porous plug 54 is placed into the opening 52. A removable closure 56 lies below the porous plug 54. The removable closure includes a gasket 57 supported on a steel plate 58, which is supported from the crucible 46 by a hinge 59. The gasket 57 is made of a refractory felt such as Kaowool or graphite felt, for example.

The porous material of the porous plug 54 is selected so that liquid phase metallic alloy at temperature $T_A$ may slowly flow therethrough, but so that the solid phase present in the metallic alloy at temperature $T_A$ may not pass therethrough. For the preferred aluminum alloys, the porous material is preferably a ceramic foam filter having 10 to 30 pores per inch, or a wire mesh filter with an opening size of about 1 millimeter.

When the metal is poured from the heating vessel 42 into the crucible 46, the removable closure 56 is in place closing the porous plug 54. The crucible 46 is then tilted so that the cylindrical axis 48 is vertical with the removable closure 56 in place, as illustrated in FIG. 5. The removable closure 56 is thereafter removed, so that liquid metal flows through the porous plug 54, as illustrated in FIG. 6, and drains under its own metallostatic head. Regardless of the weight fraction solids content of the mixture prior to removal of the liquid metal in this step, if the crucible is allowed to drain under its own metallostatic head the final solid loading achieved is approximately the same at about 45 weight percent solids, and is such that the mixture forms a free-standing mass.

FIG. 7 illustrates the semi-solid structure of the metallic alloy at the end of step 26, before removal of some of the liquid phase from the alloy, and FIG. 8 illustrates the solid-enriched semi-solid structure of the metallic alloy at the end of step 28, after some of the liquid phase has been removed. In each case, there are non-dendritic, globular solid masses of solid phase 60 dispersed in the liquid phase 62. The difference is that the weight fraction of solid phase 60 is lower initially (FIG. 7) but then increases (FIG. 8) upon removal of liquid phase 62. The metallic alloy, held at a constant temperature $T_A$, is thereby concentrated relative to the amount of solid phase that is present in step 26, without changing the temperature of the metallic alloy.

Preferably, the semi-solid structure has less than about 50 percent, most preferably from about 20 to about 35 percent, by weight of the solid phase 60 at the end of step 26. This relatively low weight fraction of solid phase 60 ensures that the solid phase 60 is surrounded by copious amounts of liquid phase 62, so that the solid phase 60 may grow and ripen to a desirable fine-grained globular structure. The weight fraction of solid phase 60 in the solid-enriched semi-solid structure increases to from about 35 to about 55 percent, most preferably about 45 weight percent, by the step 28.

In determining the weight fractions of solids discussed in the preceding paragraph, a specific procedure is used. The value of $T_I$ is first selected, and the value of $T_I-T_L$ is calculated. An equivalent starting temperature $T_I^{Model}$ is calculated as 660° C.+($T_I-T_L$). The superheat of an amount of pure aluminum, equal in weight to that of the quantity of aluminum alloy to be processed, in cooling from $T_I^{Model}$ to 660° C. is calculated. The change in enthalpy of the crucible in heating from its starting temperature (usually room temperature) to 660° C. is calculated, corrected for the amount of heat lost from the surface of the crucible during the time the molten alloy is in the crucible. An enthalpy balance using the latent heat of fusion of pure aluminum is used to calculate to amount of solid pure aluminum formed at the end of that time. For the present purposes, this quantity is taken as equal to the amount of solids formed in the alloy on initial cooling. The weight fraction of solids in the semi-solid mass after draining the liquid is determined from the amount of liquid alloy removed compared to the total amount of material original present. The volume fractions may be determined from the weight fraction using solid and liquid densities. The density of the solid is about 2.65 grams per cubic centimeter, and the density of the liquid is about 2.3 grams per cubic centimeter.

This liquid-removal step 28 leads to a change in the elemental composition of the alloy, because the liquid phase will be either deficient (if a positive slope to the liquidus, FIG. 3) or enriched (if a negative slope to the liquidus, FIG. 2) in solute elements. The initial bulk composition may be adjusted, if desired, to compensate for this change. For example, it has been found that for conditions under which 30 percent by weight solids are formed and liquid is removed to reach 45 weight percent solids, an aluminum-8 weight percent silicon alloy is used to produce a final product having a composition of aluminum-7 weight percent silicon.

At this weight fraction of solid phase, the metallic alloy becomes a self-supporting mass 64, as illustrated in FIG. 9. That is, the behavior of the mass 64 is sufficiently similar to a solid that it may be removed from the crucible 46 and handled, without disintegration. The mass 64 may then be used immediately for further processing. The mass 64 may instead may be further cooled to increase the volume fraction of solids present prior to subsequent processing, thereby increasing the rigidity of the mass 64 for handling. Another alternative is to allow the mass 64 to cool further, so that the remaining liquid solidifies, and later reheat the mass into the semi-solid range for further processing.

The metallic alloy is thereafter formed into a shape, numeral 30. The preferred forming approach is high-pressure die casting, using an apparatus like that of FIG. 10. The self-supporting mass 64 is placed into a die sleeve 70 with a plunger 72 on one end and a channel 74 on the other end leading to a mold 76. An interior surface 78 of the mold 76 defines a die cavity 80 in the shape to be formed. The plunger 72 is moved (to the right in FIG. 10) to force the material of the self-supporting mass 64 into the die cavity 80. The high-pressure die casting is performed at a temperature above $T_S$and below $T_L$, typically at $T_A$. The shape in the die cavity is allowed to cool below $T_S$, and usually to room temperature, completing the fabrication. Other operable techniques for forming the shape, such as squeeze casting, may also be used.

The following examples illustrate aspects of the invention. They should not, however, be interpreted as limiting of the invention in any respect.

EXAMPLE 1

Using the apparatus and procedure described above, a semi-solid version of A356 alloy was produced. About 2.8 kilograms of A356 alloy at 660° C. was transferred to a crucible at room temperature, 25° C. (About 0.01 percent titanium grain refiner was added to the A356 alloy as a 5:1 titanium:boron grain refiner rod.) The crucible had an inside diameter of 3.5 inches and a length of 10 inches. The crucible was made of 16 gauge steel tube and weighed 956 grams. The metal was swirled in the crucible for 60 seconds, and then the removable closure was removed to allow the liquid to drain for 45 seconds. The freestanding solid product was thereafter removed from the crucible and measured. This test was run three times on three fresh lots of the A356 alloy. Test results for the mass balance are as follows.

TABLE 1

| | Mass Balance | | | | |
|---|---|---|---|---|---|
| Test | Wt. product (grams) | Weight filtrate (grams) | Yield (percent) | Total Weight (grams) | Weight percent solids |
| 1 | 1979 | 860 | 70 | 2839 | 45 |
| 2 | 2002 | 810 | 71 | 2812 | 45 |
| 3 | 2078 | 730 | 74 | 2808 | 43 |

The chemical compositions of the starting material, the product, and the filtrate were determined using optical emission spectroscopy. In order to obtain samples suitable for analysis the products and the filtrates were each remelted and samples cast as disks. The results follow.

TABLE 2

| | Composition (Weight Percent) | | | | | | | | |
|---|---|---|---|---|---|---|---|---|---|
| | Starting Composition | | | Product | | | Filtrate | | |
| Test | 1 | 2 | 3 | 1 | 2 | 3 | 1 | 2 | 3 |
| Si | 7.26 | 7.18 | 6.91 | 6.36 | 6.43 | 6.52 | 8.58 | 8.72 | 8.83 |
| Mg | 0.37 | 0.37 | 0.35 | 0.32 | 0.32 | 0.33 | 0.44 | 0.44 | 0.46 |
| Fe | 0.045 | 0.045 | 0.044 | 0.040 | 0.041 | 0.043 | 0.056 | 0.057 | 0.059 |
| Ti | 0.14 | 0.13 | 0.15 | 0.16 | 0.16 | 0.15 | 0.073 | 0.068 | 0.063 |

EXAMPLE 2

Example 1 was repeated, except that AA6061 alloy (with the same grain refiner addition as described in Example 1) was used and the quantity of alloy was heated to 700° C. before pouring. Test results for the mass balance are as follows.

TABLE 3

| | Mass Balance | | | | |
|---|---|---|---|---|---|
| Test | Wt. product (grams) | Weight filtrate (grams) | Yield (%) | Total Weight (grams) | Weight percent solids |
| 4 | 2101 | 640 | 77 | 2741 | 43 |
| 5 | 2045 | 720 | 74 | 2765 | 41 |
| 6 | 2200 | 670 | 77 | 2870 | 41 |

TABLE 4

| | Composition (Weight Percent) | | | | | | | | |
|---|---|---|---|---|---|---|---|---|---|
| | Starting Composition | | | Product | | | Filtrate | | |
| Test | 4 | 5 | 6 | 4 | 5 | 6 | 4 | 5 | 6 |
| Si | 0.51 | 0.51 | 0.51 | 0.45 | 0.44 | 0.48 | 0.73 | 0.63 | 0.68 |
| Mg | 0.88 | 0.90 | 0.90 | 0.80 | 0.81 | 0.87 | 1.12 | 1.03 | 1.09 |
| Fe | 0.15 | 0.16 | 0.15 | 0.14 | 0.13 | 0.15 | 0.22 | 0.20 | 0.21 |
| Cu | 0.23 | 0.23 | 0.21 | 0.21 | 0.20 | 0.20 | 0.30 | 0.28 | 0.29 |
| Ti | 0.17 | 0.18 | 0.18 | 0.19 | 0.20 | 0.20 | 0.029 | 0.073 | 0.042 |

The results of Tables 2 and 4 illustrate the general manner in which the composition of a modified alloy composition may be determined, such that, when processed by the approach described herein and used in the examples, the resulting product has a desired base alloy composition. In Table 2, Test 1, the silicon content of the starting material is about 7.26 percent, and the silicon content of the product is about 6.36 percent. That is, the silicon content decreases about 0.9 percent between the starting composition and the product. To achieve a product having 7.26 weight percent of silicon, it would be necessary to start with a modified alloy composition of about 7.26+0.9, or about 8.16 weight percent silicon. A similar calculation may be used for the other elements. The percentages of some of the elements decrease from the starting composition to the final product, while others (e.g., titanium in this case) increase. This simple calculational example assumed a linear change in alloying compositions. To be more precise, the approach of the Examples could be repeated with the modified alloy compositions as the starting material, and the final product analyzed to determine whether the linear calculation was correct. That is, the procedure could be performed recursively. However, in many cases a single procedure such as that of the examples will yield the required composition of the modified alloy to sufficient accuracy.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for processing a metallic alloy having a liquidus temperature and a solidus temperature, the method comprising the steps of providing the metallic alloy having a semi-solid range between the liquidus temperature and the solidus temperature of the metallic alloy;

heating the metallic alloy to an alloy initial elevated temperature above the liquidus temperature;

reducing the temperature of the metallic alloy from the initial metallic alloy elevated temperature to a semi-solid temperature of less than the liquidus temperature and more than the solidus temperature, wherein the step of reducing the temperature includes the steps of providing a crucible at a crucible initial temperature below the solidus temperature, pouring the metallic alloy into the crucible, and allowing the metallic alloy and the crucible to reach a thermal equilibrium between the liquidus temperature and the solidus temperature of the metallic alloy;

and maintaining the metallic alloy at the semi-solid temperature for a sufficient time to produce a semi-solid structure in the metallic alloy of a globular solid phase dispersed in a liquid phase, wherein said crucible has a predetermined mass, heat capacity and initial temperature and a predetermined quantity of said metallic alloy is provided at a predetermined initial temperature above the liquidus temperature of the alloy, said predetermined temperature, quantity, mass, heat capacity and initial temperature being selected such that said temperature at which said thermal equilibrium is reached is between the liquidus and solidus temperatures of the alloy, and wherein the predetermined mass, heat capacity and initial temperature of said crucible and said semi-solid temperature define an enthalpy chance of the crucible, and the alloy predetermined initial temperature and the mass and heat capacity of said predetermined quantity of the alloy and said semi-solid temperature together with the fraction of the quantity of alloy that has solidified at the semi-solid temperature and the heat of fusion of transformation of the alloy from liquid to solid define an enthalpy change of the quantity of metallic alloy poured into the crucible, such that the enthalpy changes of the quantity of metallic alloy and the crucible differ only by the radiative and convective heat losses from the surface of the crucible.

2. The method of claim 1, wherein a temperature rate of weight fraction change is about 2 weight percent per degree C. at the semi-solid temperature.

3. The method of claim 1, wherein the metallic alloy is an aluminum alloy.

4. The method of claim 1, wherein the metallic alloy is mixed with a solid reinforcement phase.

5. The method of claim 1, wherein the step of reducing the temperature includes the step of pouring the metallic alloy into a crucible, and wherein the metallic alloy within the crucible is swirled during the step of pouring.

6. The method of claim 1, wherein the step of maintaining includes the step of maintaining the metallic alloy at the semi-solid temperature for a time of more than about 1 second and less than about 5 minutes.

7. The method of claim 1, including an additional step, after the step of maintaining, of placing the metallic alloy having the solid-enriched semi-solid structure into a die casting machine, and die casting the metallic alloy having the solid-enriched semi-solid structure.

* * * * *